US007486129B2

(12) United States Patent
Pietri et al.

(10) Patent No.: US 7,486,129 B2
(45) Date of Patent: Feb. 3, 2009

(54) LOW POWER VOLTAGE REFERENCE

(75) Inventors: Stefano Pietri, Campinas (BR); Jader Alves De Lima Filho, Campinas (BR); Alfredo Olmos, Campinas (BR)

(73) Assignee: Freescale Semiconductor, Inc., Austin, TX (US)

( * ) Notice: Subject to any disclaimer, the term of this patent is extended or adjusted under 35 U.S.C. 154(b) by 16 days.

(21) Appl. No.: 11/681,067

(22) Filed: Mar. 1, 2007

(65) Prior Publication Data

US 2008/0218253 A1 Sep. 11, 2008

(51) Int. Cl.
*G05F 1/10* (2006.01)
*G05F 3/02* (2006.01)

(52) U.S. Cl. ..... 327/539

(58) Field of Classification Search ..... 327/539, 327/541, 543; 323/313
See application file for complete search history.

(56) References Cited

U.S. PATENT DOCUMENTS 5,554,953 A * 9/1996 Shibayama et al. ..... 327/541
5,751,142 A * 5/1998 Dosho et al. ..... 323/316
6,057,721 A * 5/2000 Nolan et al. ..... 327/143
6,507,179 B1 1/2003 Jun et al.
6,677,808 B1 1/2004 Sean et al.
6,815,941 B2 11/2004 Butler
6,833,742 B2 * 12/2004 Shimizu et al. ..... 327/143
6,853,238 B1 2/2005 Dempsey et al.
6,911,862 B2 6/2005 Marotta et al.
6,919,753 B2 7/2005 Wang et al.
2002/0158682 A1 * 10/2002 Conte et al. ..... 327/539
2005/0001605 A1 1/2005 Marinca
2005/0151528 A1 7/2005 Marinca
2006/0001412 A1 1/2006 Fernald
2006/0001413 A1 1/2006 Marinca
2006/0197584 A1 * 9/2006 Hsu ..... 327/539
2008/0042737 A1 * 2/2008 Kim et al. ..... 327/539

* cited by examiner

*Primary Examiner*—Quan Tra
(74) *Attorney, Agent, or Firm*—Dillon & Yudell LLP

(57) ABSTRACT

A voltage reference includes a first cell configured to receive a first proportional to absolute temperature (PTAT) current and a second cell configured to receive a second PTAT current. The first cell includes a diode-connected stack of insulated-gate field-effect transistors (IGFETs). The diode-connected stack of IGFETs includes a first transistor that is configured to be biased in a triode weak inversion region. The second cell includes a diode-connected stack of IGFETs and a serially coupled resistor. A magnitude of the second PTAT current is based on a drain-to-source voltage of the first transistor and a value of the serially coupled resistor. The voltage reference provides a reference voltage at a reference node of the second cell based on the second PTAT current.

18 Claims, 3 Drawing Sheets

-PRIOR ART-

-PRIOR ART-

LOW POWER VOLTAGE REFERENCE

BACKGROUND OF THE INVENTION

1. Field of the Invention

The present disclosure relates generally to a voltage reference and, more particularly, to a low power voltage reference.

2. Description of the Related Art

Today, systems, such as battery-powered systems, are usually designed to enter a low-power mode when the systems are not being utilized. When in the low-power mode it is desirable for the systems to consume a relatively small amount of power. In systems that utilize voltage references, it is desirable for the voltage references to be designed to consume a relatively small amount of power during normal operation, as well as when the systems are in a low-power mode. Voltage references are used in a variety of different applications. For example, analog-to-digital converters (ADCs), digital-to-analog converters (DACs), oscillators, flash memories, and voltage regulators usually require a voltage reference that is relatively insensitive to temperature, power supply, and load variations. The resolution of an ADC or a DAC, for example, is generally limited by the precision of an associated reference voltage over a power supply voltage range and operating temperature range.

Traditionally, bandgap voltage references have employed bipolar junction transistors (BJTs) to generate a relatively temperature independent reference voltage. In general, bandgap voltage references exhibit a relatively high power supply rejection ratio (PSRR) and a relatively low temperature coefficient. To reduce power consumption of integrated circuits (ICs), many IC designers have migrated from bipolar to complementary metal-oxide semiconductor (CMOS) processes. While bipolar CMOS (BiCMOS) processes may be used in the design of a bandgap voltage reference, BiCMOS devices are relatively expensive, as compared to CMOS devices. Moreover, bandgap voltage references have usually employed ratiometric related resistors. In a bandgap voltage reference, in order to provide for relatively low current, one resistor of the bandgap voltage reference is typically many times the size of another resistor. It should be appreciated that larger area resistors increase an area of an associated IC which, in turn, has increases the cost of the associated IC.

U.S. Patent Application Publication No. 2006/0001412 (hereinafter "the '412 application") discloses a voltage reference that is fabricated exclusively using CMOS processes. The voltage reference of the '412 application employs a current generator that provides a proportional to absolute temperature (PTAT) current. A stack of serially coupled metal-oxide semiconductor field-effect transistors (MOSFETs) is coupled between the current generator and a common point, i.e., ground. The stack of MOSFETs have a transimpedance which has a temperature coefficient that is opposite in polarity to a temperature coefficient of an internal resistance of the current generator. As such, the voltage reference of the '412 application provides a reference voltage that is relatively stable over temperature.

Referring to FIG. 1, a conventional voltage reference 100, disclosed in the '412 application, is illustrated. The reference 100 includes a current mirror (including p-channel MOSFETs M1, M2, and M3), n-channel MOSFETs M4 and M5, a resistor R1, and an output load 102, which includes a stack of saturated and linear n-channel MOSFETs that conduct a proportional to absolute temperature (PTAT) current. In a disclosed embodiment, the MOSFET M1 is sized at 'X', the MOSFET M2 is sized at '2X' and the MOSFET M3 is sized at 'X'. As such, the current flowing through the MOSFETs M1 and M3 is I1 and the current flowing through the MOSFET M2 is 2I1. The currents I1 and 2I1 are PTAT currents and a magnitude of the current 2I1 (and correspondingly the current I1) is determined by a difference in gate-to-source voltage (delta−Vgs) of the MOSFETs M4 and M5 divided by a value of the resistor R1. The MOSFET M4 is diode-connected and conducts the current I1 provided via the MOSFET M1. The MOSFET M5 conducts the current 2I1 provided via the MOSFET M2. Similarly, the load 102 conducts the current I1 provided via the MOSFET M3. The resistor R1 is coupled between the MOSFET M5 and a common point (VSS). An impedance of the load 102 varies as a function of temperature to maintain a reference voltage (VREF) at a substantially temperature independent level. That is, when the PTAT current increases, the impedance of the load 102 decreases. Moreover, when the PTAT current decreases, the impedance of the load 102 increases.

The load 102 includes a stack 104, which includes multiple diode-connected n-channel MOSFETs in series. In this configuration, the MOSFETs of the stack 104 operate in a saturated region (i.e., Vgs>Vth and Vds>Vgs−Vth, where Vgs is the gate-to-source voltage, Vth is the threshold voltage, and Vds is the drain-to-source voltage). A drain-to-source voltage (Vds) of each of the MOSFETs of the stack 104 is equal to a gate-to-source voltage (Vgs), due to the manner in which the MOSFETs are connected. Each of the MOSFETs of the stack 104 may be switched out of the circuit by activating an appropriate p-channel MOSFET to modify a level of the reference voltage (VREF).

The load 102 also includes two variable length MOSFET structures 106, which effectively provide a MOSFET with a variable length for a given width. The variable length MOSFET structures 106 are serially connected between the stack 104 and another variable length MOSFET structure 108. Each of the variable length MOSFET structures 106 includes a first diode-connected n-channel MOSFET that is serially coupled to a string of n-channel MOSFETs. Gates of the MOSFETs, of the MOSFET string, are coupled to a gate of the first diode-connected MOSFET. In the disclosed configuration, the MOSFETs of the structures 106 operate in a saturated region such that the gate-to-source voltage (Vgs) of the structures 106 may be varied by varying the number of MOSFETs in the structure 106. That is, selected MOSFETs of the structure 106 may be shorted by activating an appropriate p-channel MOSFET to change a length of the structure 106 to affect a change in the gate-to-source voltage and an associated change in the reference voltage. The structure 108 is similar to the structures 106, with the exception that a first MOSFET in the string is not diode connected. The structures 106 function as a linear drain-to-source resistor ($r_{ds}$) with a positive temperature coefficient (PTC). Moreover, the structure 108 operates in a linear region (i.e., Vgs>Vth and Vds<Vgs−Vth) as the gates of the MOSFETs of the structure 108 are coupled to an output of the stack 104. As such, a voltage across the structure 108 is the drain-to-source voltage (Vds) of the structure 108. To effect a temperature coefficient adjustment for the load 102, selected MOSFETs of the structure 108 may be shorted.

U.S. Pat. No. 6,919,753 (hereinafter "the '753 patent"), discloses a voltage reference that is also fabricated exclusively using CMOS processes. With reference to FIG. 2, a voltage reference 200, configured according to the '753 patent, includes two p-channel metal-oxide semiconductor field-effect transistors (MOSFETs) M1 and M2, two n-channel MOSFETs M3 and M4, and two resistors R1 and R2, which may be variable resistors. The MOSFETs M1 and M2 provide a current mirror. The MOSFETs M3 and M4, whose gates are interconnected, and the resistors R1 and R2 provide a temperature compensation circuit. The temperature compensation circuit is configured to generate a reference voltage (VREF) whose level is relatively independent of temperature. The MOSFET M4, which is a diode-connected MOSFET, receives a proportional to absolute temperature (PTAT) current I1 provided via the MOSFET M2. In the disclosed configuration, the MOSFET M3 and the resistor R1 also conduct a current I1 provided via the MOSFET M1 (i.e., the current mirror including the MOSFETs M1 and M2 is a 1:1 current mirror). The current I1 is a PTAT current and a magnitude of the current I1 is determined by a difference in gate-to-source voltage (delta−Vgs) of the MOSFETs M3 and M4 divided by a value of the resistor R1. In a disclosed configuration, the MOSFETs M3 and M4 operate near a subthreshold region (i.e., gate-to-source voltage (Vgs) is approximately equal to a threshold voltage (Vth)). The gate-to-source voltage (Vgs) of the MOSFET M4 is complementary to absolute temperature (CTAT). The reference 200 provides a reference voltage that includes a first term that is a proportional to absolute temperature (PTAT) voltage and a second term that is a complementary to absolute temperature (CTAT) voltage. The first term corresponds to a voltage drop across the resistor R2 and the second term corresponds to a threshold voltage of the diode-connected MOSFET M4. A reference voltage provided by the reference 200 is determined by the ratios of the MOSFETs M3 and M4 and values selected for the resistors R1 and R2. The reference 200 utilizes an operating current of several microamperes and requires matching of the MOSFETs M3 and M4 and proper selection of values for the resistors R1 and R2 to provide a reference voltage that is relatively stable.

In a typical bandgap voltage reference, a change in base-to-emitter voltage (delta−Vbe) of a transistor provides a PTAT contribution to a reference voltage and a base-to-emitter voltage (Vbe) of a transistor provides a CTAT contribution to the reference voltage that counteracts the PTAT contribution. Similarly, voltage references that employ MOSFETs operating in a weak inversion region (i.e., an effective gate-to-source voltage (Veff, where Veff=Vgs−Vth) between about 3 Ut to 5 Ut, where Ut is the thermal voltage) have been configured to employ a difference in gate-to-source voltage (delta−Vgs) to provide a PTAT contribution to a reference voltage and a gate-to-source voltage (Vgs) to provide a CTAT contribution to the reference voltage. In either case, summing the PTAT contribution and the CTAT contribution using a selected ratio provides a reference voltage that is relatively independent of process and temperature variations. However, weak bipolar junction transistors created in CMOS processes usually require a minimum operating current of about one microampere in order to bias the bipolar junction transistors at a relatively high beta operating point. Furthermore, MOSFETs operating in a 'weak inversion region' are highly sensitive to threshold voltage (Vth) variations, as a current conducted by a MOSFET operating in a 'weak inversion region' is exponentially proportional to a gate-to-source voltage (Vgs) minus a threshold voltage (Vth) divided by a thermal voltage (Ut), i.e., exp(Vgs−Vth/Ut).

What is needed is a voltage reference that requires a relatively low operating power. It would also be desirable if the voltage reference was designed to be substantially insensitive to threshold voltage variations.

BRIEF DESCRIPTION OF THE DRAWINGS

This invention is described in a preferred embodiment in the following description with reference to the drawings, in which like numbers represent the same or similar elements, as follows.

In the following detailed description of exemplary embodiments of the invention, reference is made to the accompanying drawings, which form a part hereof, and in which is shown by way of illustration specific exemplary embodiments in which the invention may be practiced.

DETAILED DESCRIPTION OF PREFERRED EMBODIMENTS

In the following detailed description of exemplary embodiments of the invention, specific exemplary embodiments in which the invention may be practiced are described in sufficient detail to enable those skilled in the art to practice the invention, and it is to be understood that other embodiments may be utilized and that logical, architectural, programmatic, mechanical, electrical and other changes may be made without departing from the spirit or scope of the present invention. The following detailed description is, therefore, not to be taken in a limiting sense, and the scope of the present invention is defined only by the appended claims. In particular, although the preferred embodiment is described below with respect to a wireless mobile communication device, it will be appreciated that the present invention is not so limited and that it has application to other embodiments of electronic devices, such as portable digital assistants (PDAs), digital cameras, portable storage devices, audio players and portable gaming devices, for example.

According to various aspects of the present disclosure, a voltage reference is disclosed that generates a reference voltage that is substantially constant over temperature and process variations. Said voltage references are highly desirable in a number of applications, e.g., battery-powered applications that employ microcontrollers. Moreover, said voltage references are highly desirable when employed with circuits that remain powered when a system power-down mode is entered. According to a disclosed embodiment, a voltage reference employs a delta−Vds/R cell (as contrasted with a delta−Vgs/R cell) to generate a proportional to absolute temperature (PTAT) current. The PTAT current is provided to a diode-connected MOS (included with the delta−Vds/R cell), whose gate-to-source voltage (Vgs) is complementary to absolute temperature (CTAT). The sum of the PTAT and CTAT contributions provide a reference voltage that is stable over temperature, while providing a voltage reference that is suitable for a wide variety of applications.

Figure 1:
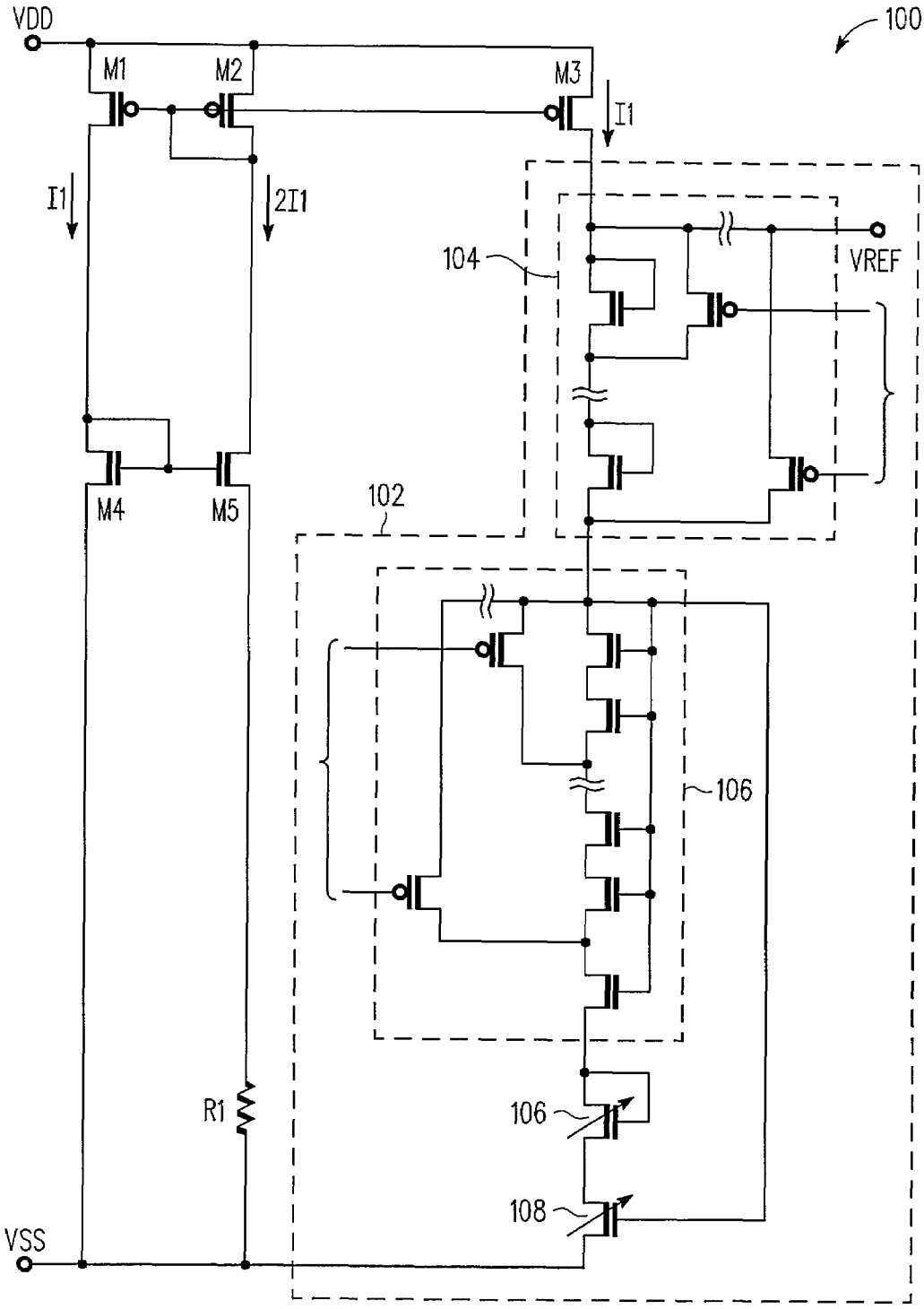
FIG. 1 is an electrical schematic diagram of a conventional voltage reference.
Figure 2:
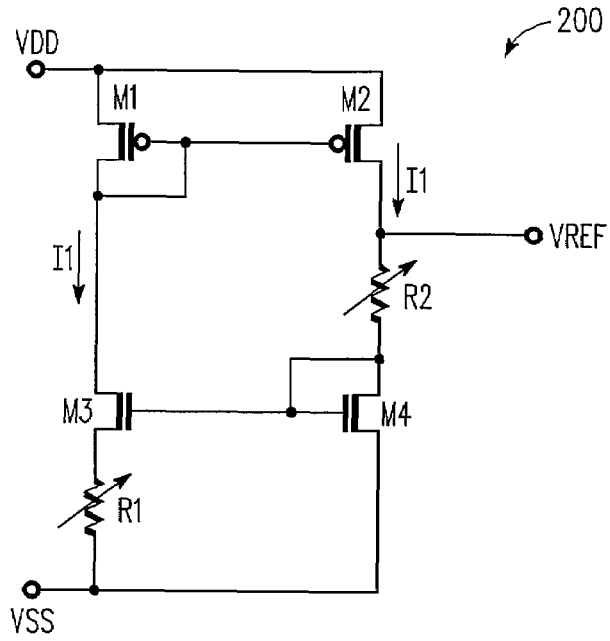
FIG. 2 is an electrical schematic diagram of another conventional voltage reference.
Figure 3:
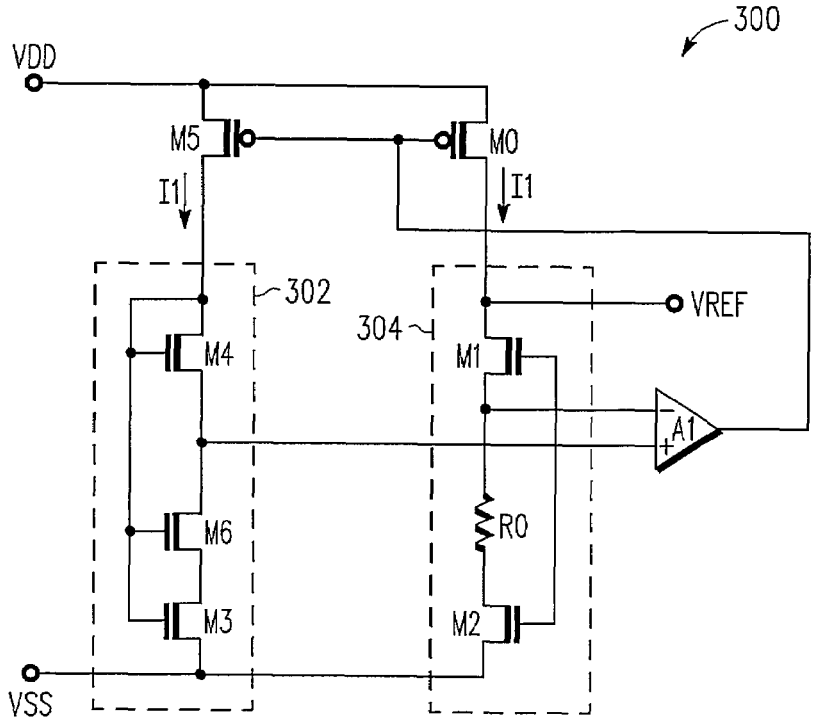
FIG. 3 is an electrical schematic diagram of a voltage reference configured according to an embodiment of the present disclosure.

With reference to FIG. 3, a voltage reference 300 is illustrated that provides a low-power reference voltage (VREF) that is substantially constant over temperature. As is shown, the voltage reference 300 includes a delta−Vds/R cell (which includes metal-oxide semiconductor field-effect transistors (MOSFETs) M0-M6 and resistor R0) and an amplifier A1, which may be an operational transconductance amplifier (OTA). The amplifier A1 is implemented in a feedback configuration to force an equal voltage on two intermediate nodes of the voltage reference 300, i.e., a first node between a source of the MOSFET M4 and a drain of the MOSFET M6 and a second node between a source of the MOSFET M1 and a first terminal of the resistor R0. A current mirror, including the MOSFETs M0 and M5, provides substantially equal proportional to absolute temperature (PTAT) currents to first and second branches of the voltage reference 300. The first branch includes a first cell 302, which includes a diode-connected stack of MOSFETs, including the MOSFETS M4, M3, and M6. The second branch includes a second cell 304, which includes a diode-connected stack of MOSFETs (including MOSFETs M1 and M2) and a resistor R0 serially coupled between a source of the MOSFET M1 and a drain of the MOSFET M2. Sources of the MOSFETs M2 and M3 are coupled to a common point (e.g., VSS) associated with a power supply (VDD). It should be appreciated that a reference voltage (VREF) provided by the voltage reference 300 may be scaled by adding additional MOSFETS in the cells 302 and 304 and modifying a current slew of the PTAT currents. While the MOSFETS M0 and M5 are illustrated as p-channel MOSFETs and the MOSFETs M1-M4 are illustrated as n-channel MOSFETs it is contemplated that the type of MOSFETs may switched (in this case, the power supply VDD and common ground reference terminal are also switched). That is, the MOSFETS M0 and M5 may be n-channel MOSFETs and the MOSFETs M1-M4 may be p-channel MOSFETs. Moreover, while the discussion herein is directed to voltage references that employ MOSFETs, the disclosure is broadly applicable to voltage references that employ insulated-gate FETs (IGFETs).

In various embodiments, the MOSFETs M0 and M5 are biased in a 'strong inversion region'. In at least one embodiment, MOSFETs M1 and M4 are equally sized and MOSFETs M2 and M3 are equally sized. The MOSFETs M1 and M4 may be biased in a 'weak inversion region' and the MOSFETS M2 and M3 may be biased in a 'triode weak inversion region'. It should be appreciated that the MOSFETs M0-M5 may be biased in different regions than the regions disclosed, depending on the application. A current flowing in each of the respective branches may be approximated using the EKV model (i.e., $Ids=Is0(1-\exp(Vds/Ut))*\exp((Vgs-Vth)/Ut)$), where Ut is the thermal voltage, which is equal to kT/q (where k is Boltzmann's constant, T is the temperature in degrees Kelvin and q is the electronic charge in Coulombs). As is well known, the thermal voltage (Ut) is approximately equal to 26 millivolts at room temperature (approximately 300 degrees Kelvin). An approximation of a drain-to-source voltage (Vds) of the MOSFET M6 is given by: $Vds(M6)=(Ut/4*\ln(Ids/Is0))+(Vth/4)=R0*Ids(M6)$, which is relatively accurate when threshold modulation is negligible as in this case.

In various disclosed embodiments, the MOSFET M6 is biased in a 'triode weak inversion region', where the drain-to source voltage of MOSFET M6 (Vds(M6)) is in the range of about one to about three times the thermal voltage (Ut) and $Vgs(M6)<Vth(M6)$. In a 'weak inversion region', a drain-to-source (Vds) voltage of a MOSFET is greater than about 3 Ut and less than or equal to about 5 Ut. In the 'weak inversion region' a drain-to-source current (Ids) of a MOSFET is substantially dependent (exponentially) on a gate-to-source voltage (Vgs) of the MOSFET and is substantially independent of a drain-to-source voltage (Vds) of the MOSFET. In the 'triode weak inversion region', a drain-to-source current (Ids) of a MOSFET is dependent on both a drain-to-source voltage (Vds) and a gate-to-source voltage (Vgs) of the MOSFET. In the 'strong inversion region', a drain-to-source (Vds) voltage of a MOSFET is greater than about 5 Ut. In one disclosed embodiment, a relatively small resistor value (e.g., 150 kOhm) may be employed for the resistor R0 to reduce a current in each branch to a relatively low value, e.g., about 50 nA or less. Unlike prior art voltage references, the PTAT current is determined by a difference in drain-to-source (Vds) voltage of multiple MOSFETs (in this case $I=(Vds(M6)+Vds(M3))-Vds(M2))/R0$), while gate-to-source voltages are maintained at a same value. Due to the relatively small value for the resistor R0, a voltage reference configured according to FIG. 3 may be designed to occupy a relatively small area and consume relatively low power.

Figure 4:
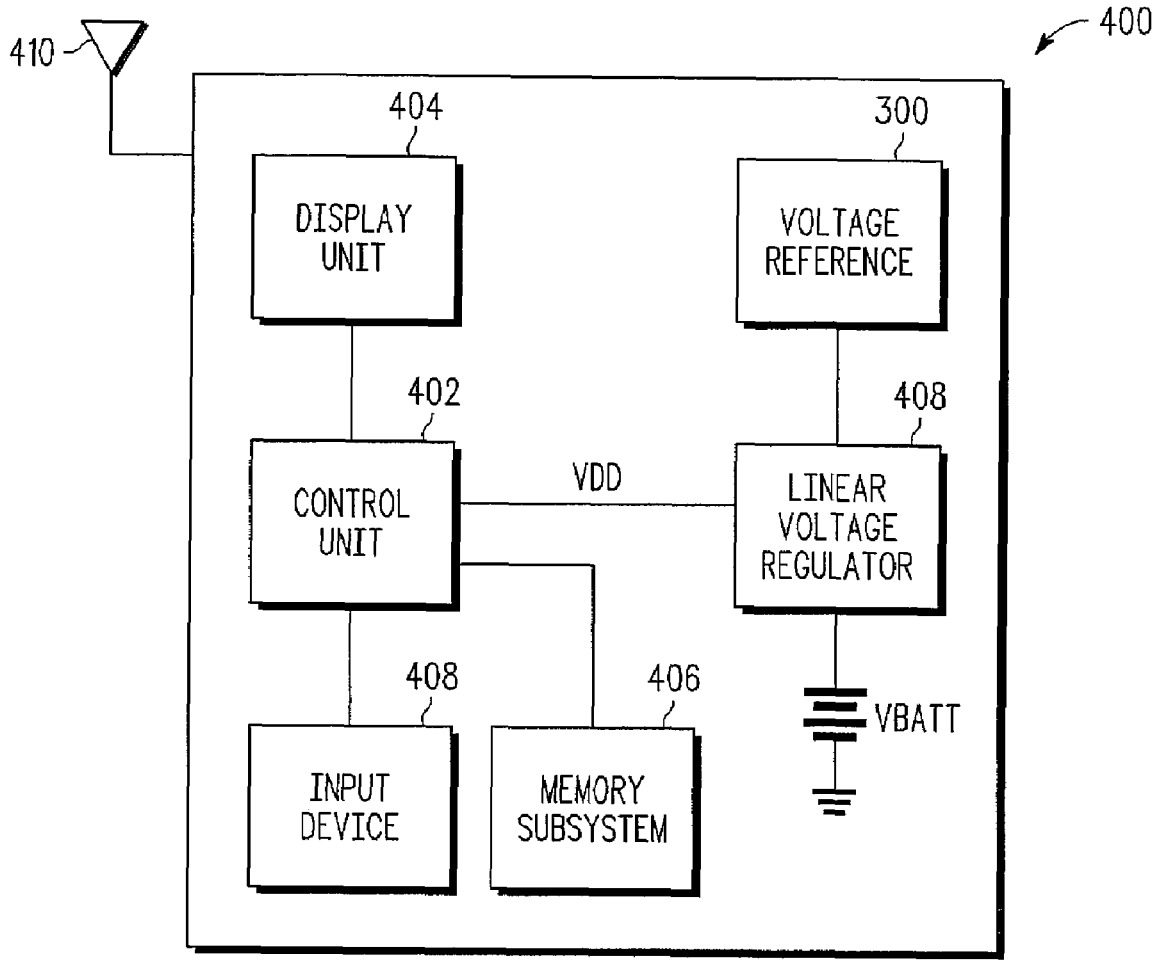
FIG. 4 is an electrical block diagram of a system employing the voltage reference of FIG. 3.

With reference to FIG. 4, an example system 400 is illustrated that employs the voltage reference 300 of FIG. 3 to provide a reference voltage to one or more components of the system 400. As is shown, the voltage reference 300 provides a reference voltage to a linear voltage regulator 408, which receives an input voltage provided by a battery (VBATT) and provides an output voltage (VDD) that powers a control unit (load) 402, which may be a microprocessor, microcontroller, etc. When the control unit 402 is programmable, various application and operating software may be stored within memory subsystem 406. The voltage reference 300 may also be employed within systems that are not battery-powered, e.g., systems that derive power from an alternating current (AC) power source. It should be appreciated that multiple of the voltage references 300 may be employed within the system 400 to provide reference voltages at different voltage levels to different devices (voltage controlled oscillators (VCOs), current references, ADCs, DACs, etc.) of the system 400. As is shown, the control unit 402 is coupled to a display unit 404, e.g., a liquid crystal display (LCD), the memory subsystem 406, and an input device 408, e.g., a keypad. The system 400 may include an antenna 410 and a transceiver (not shown) when the system 400 takes the form of a mobile wireless communication device.

While the invention has been particularly shown and described with reference to preferred embodiments, it will be understood by those skilled in the art that various changes in form and detail may be made therein without departing from the spirit and scope of the invention. Any variations, modifications, additions, and improvements to the embodiments described are possible and may fall within the scope of the invention as detailed within the following claims.

What is claimed is:

1. A voltage reference, comprising:

a current mirror including a first node, a second node, a third node and a control input, wherein the first node of the current mirror is coupled to a first power supply node associated with a first power supply;

a first cell including a diode-connected stack of insulated-gate field-effect transistors (IGFETs), wherein the first cell is coupled between the second node of the current mirror and a second power supply node associated with the first power supply and the diode-connected stack of IGFETs includes a first transistor that is biased in a triode weak inversion region;

a second cell including a diode-connected stack of IGFETs and a serially coupled resistor, wherein the second cell is coupled between the third node of the current mirror and the second power supply node and the second cell is configured to provide a reference voltage at a reference node; and an amplifier including a first input, a second input and an output, wherein the first input of the amplifier is coupled to a first intermediate node of the first cell, the second input of the amplifier is coupled to a first intermediate node of the second cell and the output of the amplifier is coupled to the control input of the current mirror, and wherein the first and second cells are configured to conduct respective proportional to absolute temperature (PTAT) currents and the amplifier is configured to force the first intermediate nodes of the first and second cells to a substantially similar voltage.

2. The voltage reference of claim 1, wherein the respective PTAT currents have substantially similar magnitudes.

3. The voltage reference of claim 1, wherein the serially coupled resistor of the second cell and the first transistor of the first cell are configured to drop substantially similar voltages responsive to the respective PTAT currents.

4. The voltage reference of claim 1, wherein the amplifier is an operational amplifier and the first input of the amplifier is a non-inverting input and the second input of the amplifier is an inverting input.

5. The voltage reference of claim 1, wherein the amplifier is an operational transconductance amplifier.

6. The voltage reference of claim 1, wherein the serially coupled resistor has a resistance value less than or equal to about 150 kOhm.

7. The voltage reference of claim 1, wherein the first transistor is configured to have a drain-to-source voltage of between about one to about three times a thermal voltage.

8. The voltage reference of claim 1, wherein a change in drain-to-source voltage of the first transistor is less than or equal to about one thermal voltage.

9. The voltage reference of claim 1, wherein the respective PTAT currents are less than about 50 nA.

10. A system, comprising:

a device; and a voltage reference coupled to the device, the voltage reference comprising:

a current mirror including a first node, a second node, a third node and a control input, wherein the first node of the current mirror is coupled to a first power supply node associated with a first power supply;

a first cell including a diode-connected stack of insulated-gate field-effect transistors (IGFETs), wherein the first cell is coupled between the second node of the current mirror and a second power supply node associated with the first power supply and the diode-connected stack of IGFETs includes a first transistor that is biased in a triode weak inversion region;

a second cell including a diode-connected stack of IGFETs and a serially coupled resistor, wherein the second cell is coupled between the third node of the current mirror and the second power supply node and the second cell is configured to provide a reference voltage for the device at a reference node; and an amplifier including a first input, a second input and an output, wherein the first input of the amplifier is coupled to a first intermediate node of the first cell, the second input of the amplifier is coupled to a first intermediate node of the second cell and the output of the amplifier is coupled to the control input of the current mirror, and wherein the first and second cells are configured to conduct respective proportional to absolute temperature (PTAT) currents and the amplifier is configured to force the first intermediate nodes of the first and second cells to a substantially similar voltage.

11. The system of claim 10, wherein the respective PTAT currents are approximately equal and are each less than about 50 nA.

12. The system of claim 11, wherein the serially coupled resistor of the second cell and the first transistor of the first cell are configured to drop substantially similar voltages responsive to the respective PTAT currents.

13. The system of claim 10, wherein amplifier is an operational amplifier and the first input of the amplifier is a non-inverting input and the second input of the amplifier is an inverting input.

14. The system of claim 13, wherein the amplifier is an operational transconductance amplifier.

15. The system of claim 10, wherein the serially coupled resistor has a resistance value less than or equal to about 150 kOhm.

16. The system of claim 15, wherein the first transistor is configured to have a drain-to-source voltage of between about one to about three times a thermal voltage.

17. The system of claim 16, wherein a change in the drain-to-source voltage of the first transistor is less than or equal to about one thermal voltage.

18. The system of claim 10, wherein the respective PTAT currents are less than about 50 nA.

* * * * *